US005346726A

United States Patent [19]

Pechhold

[11] Patent Number: 5,346,726

[45] Date of Patent: Sep. 13, 1994

[54] MALEIC ANHYDRIDE/VINYL OR ALLYL ETHER POLYMER STAIN-RESISTS

[75] Inventor: Engelbert Pechhold, Chadds Ford, Pa.

[73] Assignee: E. I. Du Pont de Nemours and Company, Wilmington, Del.

[21] Appl. No.: 962,156

[22] Filed: Oct. 15, 1992

Related U.S. Application Data

[63] Continuation-in-part of Ser. No. 634,794, Dec. 27, 1990, abandoned.

[51] Int. Cl.[5] ..... D06M 15/19

[52] U.S. Cl. ..... 427/393.4; 8/115.62; 8/115.63

[58] Field of Search ..... 8/115.62, 115.63; 427/393.4

[56] References Cited

U.S. PATENT DOCUMENTS

| | | | |
|---|---|---|---|
| 3,488,311 | 1/1970 | Burdick et al. | 524/811 |
| 3,632,391 | 1/1972 | Whitfield et al. | 428/270 |
| 3,637,596 | 1/1972 | Gulbins et al. | 8/115.6 |
| 3,706,594 | 12/1972 | Wasley et al. | 117/139.5 A |
| 3,897,206 | 7/1975 | Kearney | 8/120 |
| 4,007,305 | 2/1977 | Kakar et al. | 427/322 |
| 4,038,027 | 7/1977 | Kearney | 8/120 |
| 4,045,172 | 8/1977 | Duncan et al. | 8/115.7 |
| 4,144,026 | 3/1979 | Keler et al. | 8/115.6 |
| 4,623,683 | 11/1986 | Villarreal et al. | 524/47 |
| 4,822,373 | 4/1989 | Olson et al. | 8/115.6 |
| 4,937,123 | 6/1990 | Chang et al. | 427/393.4 |
| 5,001,004 | 3/1991 | Fitzgerald et al. | 428/263 |
| 5,074,883 | 12/1991 | Wang | 427/393.4 |
| 5,118,551 | 6/1992 | Calcaterra et al. | 428/96 |
| 5,135,774 | 8/1992 | Calcaterra et al. | 427/393.4 |

*Primary Examiner*—Shrive Beck
*Assistant Examiner*—Erma Cameron
*Attorney, Agent, or Firm*—Charles E. Feeny

[57] ABSTRACT

A polyamide fibrous substrate having deposited on it an amount of a composition effective to impart stain-resistance comprising a water-soluble or water-dispersible maleic anhydride/allyl ether or vinyl ether polymer or a mixture of said polymers, and processes for preparing the substates. The maleic anhydride polymer is used either in hydrolyzed form.

14 Claims, No Drawings

MALEIC ANHYDRIDE/VINYL OR ALLYL ETHER POLYMER STAIN-RESISTS

CROSS-REFERENCE TO RELATED APPLICATION

This is a continuation of application Ser. No. 07/634,794 filed Dec. 27, 1990, now abandoned.

FIELD OF THE INVENTION

The present invention relates to polyamide textile substrates treated with stain-resistant compositions comprising water-soluble or water-dispersible maleic anhydride/vinyl ether or maleic anhydride/allyl ether polymers, and processes for their synthesis. The substrates of this invention possess stain-resistance but do not suffer from yellowing to the extent that some previously known materials do.

BACKGROUND OF THE INVENTION

Polyamide substrates, such as nylon carpeting, upholstery fabric and the like, are subject to staining by a variety of agents, e.g., foods and beverages. An especially troublesome staining agent is FD&C Red Dye No. 40, commonly found in soft drink preparations. Different types of treatments have been proposed to deal with staining problems. One approach is to apply a highly fluorinated polymer to the substrate. Another is to use a composition containing a sulfonated phenol-formaldehyde condensation product.

For example, Liss et al., in U.S. Pat. No. 4,963,409, disclose stain-resistant synthetic polyamide textile substrates having deposited on them sulfonated phenol-formaldehyde polymeric condensation products. However, sulfonated phenol-formaldehyde condensation products are themselves subject to discoloration; commonly they turn yellow. Yellowing problems are described by W. H. Hemmpel in a Mar. 19, 1982 article in *America's Textiles*, entitled Reversible Yellowing Not Finisher's Fault. Hemmpel attributes yellowing to exposure of a phenol-based finish to nitrogen oxides and/or ultraviolet radiation. To deal with the yellowing problem, the condensation products were modified by Liss et al. by acylation or etherification of some of the phenolic hydroxyls. In a preferred embodiment disclosed by Liss et al., the modified condensation products were dissolved in a hydroxy-containing solvent, such as ethylene glycol prior to there being applied to the textile substrate.

Allen et al., in U.S. Pat. No. 3,835,071, disclose rug shampoo compositions which upon drying leave very brittle, non-tacky residues which are easily removed when dry. The compositions comprise water-soluble metal, ammonium or amine salt of a styrene-maleic anhydride copolymer, or its half ester, and a detergent. Water-soluble metal salts of Group II and the alkali metals (particularly magnesium and sodium) are preferred and ammonium salts are most preferred by Allen et al.

On the other hand, Fitzgerald et al., in U.S. patent application Ser. No. 07/502,819, filed Apr. 2, 1990, now U.S. Pat. No. 5,001,004 disclose the usefulness of aqueous solutions of hydrolyzed vinylaromatic/maleic anhydride copolymers in the treatment of textiles to render them resistant to staining. The preferred copolymer of Fitzgerald et al. is a hydrolyzed styrene/maleic anhydride copolymer. Fitzgerald et al. disclose that the monoalkyl ester of their maleic anhydride/vinyl aromatic polymer was ineffective as a stain-resist. Moreover, hydrolyzed maleic anhydride/alpha-olefin polymer stain-resists (a hydrolyzed maleic anhydride/isobutylene polymer being preferred) are disclosed in my copending U.S. patent application Ser. No. 07/809,843 filed Dec. 18, 1991 which is a continuation-in-part of application Ser. No. 07/626,885 filed Dec. 13, 1990.

Polymers formed from maleic anhydride vinyl- or allyl-ethers are known. See for example: *Ind. & Eng. Chem.* 41, 1509 (1949) Seymour et.al. "Copolymers of vinyl compounds and maleic anhydride"; *J. Phys. Chem.* 74, 2842 (1970) Dubin et.al. "Hydrophobic bonding in alternating copolymers of maleic acid and alkyl vinyl ethers"; *Europ. Polym. J.*, 6, 247–58 (1970), Wojtczak et.al., "Etude de la morphologie de copolymers . . . "; *Polym. Prepr., ACS, Div. Polym. Chem.*, 12(1), 445–8 (1971), Wasley et.al., "Copolymers of fluoroalkyl ethers and maleic anhydride"; *Charged React. Polym.*, 2 (*Polyelectrolytes their Appl.*), 3–13(1975), Dubin et.al., "Hypercoiling in hydrophobic polyacids"; *J. Natl. Sci. Counc. Sri Lanka*, 7(1), 45–55 (1979), Fujimori et.al., "The alternating copolymerization of n-butyl vinyl ether with maleic anhydride"; Brit. Pat. 1,117,515 "Maleic anhydride-alkyl vinyl ether copolymers"; DE Pat. 2208020 "Fluoroalkyl ether/maleic anhydride copolymers for finishing textiles." (The anhydride copolymer is claimed as soil release agent for wool, cotton and/or polyester textiles from solution in organic solvents); U.S. Pat. No. 4,029,867 "Terpolymers of fluoroalkyl ethers and maleic anhydride".

BRIEF SUMMARY OF THE INVENTION

The present invention provides polyamide fibrous substrates treated with one or more water-soluble or water-dispersible maleic anhydride/vinyl ether polymers and/or allyl ether polymers so as to impart stain-resistance to the substrates, and methods for preparing the same. Commonly, prior art materials known to be useful as stain-blockers were sulfonated phenol-formaldehyde condensates (excepting those of Fitzgerald et al. and those disclosed in my copending application, both cited above). Finding a non-sulfonated material, such as the water-soluble or water-dispersible maleic anhydride/allyl ether or maleic anhydride/vinyl ether polymers of this invention, to be useful for this purpose was unexpected.

DETAILED DESCRIPTION OF THE INVENTION

The present invention relates to the use of water-soluble or water-dispersible vinyl ether/maleic anhydride polymers or allyl ether/maleic anhydride polymers, or mixtures of the same, as stain-resists for fibrous polyamides. A variety of allyl ethers and vinyl ethers can be used for the purposes of this invention. Particularly useful ethers include those which can be represented by the formula:

$$CH_2{=}CH{-}(CH_2)_k{-}O{-}(CH_2)_m{-}(A)_n{-}R$$

wherein

R is hydrogen or an alkyl radical containing 4 to 8 carbon atoms, or 2,3-epoxypropyl, or an alicyclic hydrocarbon radical containing 6 to 12 carbon atoms or an aromatic hydrocarbon radical containing 6 to 12 carbon atoms or a perfluoroalkyl radical containing 3 to 16 carbon atoms, preferably 6 to 12, and which may contain a terminal —$CF_2H$ group;

A is a divalent radical —SO2$R^1$— or —CONR$^1$— in which $R^1$ is hydrogen or an alkyl radical containing 1 to 6 carbon atoms;

k is 0 or 1;

m is 0 or 2; and n is 0 or 1;

provided that when R is aromatic, K is 1.

Particular examples include, n-butyl vinyl ether, isobutyl vinyl ether, iso-octyl vinyl ether, 2-perfluorohexylethyl vinyl ether, allyl n-butyl ether, allyl phenyl ether, allyl glycidyl ether, and the like.

The polymers suitable for the purposes of this invention contain between about 0.7 and 1.3 polymer units derived from one or more allyl or vinyl ether monomers per polymer unit derived from maleic anhydride. Polymers containing about one polymer unit derived from one or more such ether monomers per polymer unit derived from maleic anhydride are most effective in imparting stain-resistance to polyamide textile substrates.

The maleic anhydride polymers useful in the present invention can be prepared according to methods well-known in the art. The maleic anhydride polymers thus obtained can be hydrolyzed to the free acid or their salts by reaction with water or alkali. Generally, the hydrolyzed maleic anhydride polymer, should be sufficiently water-soluble that uniform application to a fibrous polyamide surface can be achieved at an appropriate acidity. However, applications using water dispersions of the polymer mixed with a suitable surfactant may be used to impart stain-resistance.

It is known that the polymerization of vinyl or allyl ethers with maleic anhydride produces alternating copolymers. To make terpolymers for the purposes of this invention, a part of the vinyl or allyl ethers can be replaced by one or more other monomers; i.e. up to 90 wt % of alpha-olefins or an ethylenically unsaturated aromatic compound, such as styrene or one or more styrene derivatives, e.g. dienes containing 4 to 18 carbon atoms, such as butadiene, chloroprene, isoprene, and 2-methyl-1,5-hexadiene; 1-alkenes containing 3 to 18 carbon atoms, preferably $C_{4-18}$, such as isobutylene, 1-butene, 1-hexene, 1-octene, 1-decene, 1-dodecene, 1-tetradecene, 1-octadecene, and the like, with isobutylene being most preferred, or styrene, alpha-methyl styrene, 4-methyl styrene, stilbene, 4-acetoxystilbene, or the like; up to 50 wt % with alkyl($C_{1-4}$) methacrylates, alkyl($C_{1-4}$) acrylates, vinyl acetate, vinyl chloride, vinylidine chloride, vinyl sulfides, acrylonitrile, acrylamide, N-vinyl pyrrolidone, as well as mixtures of the same. A part (1–75%) of the maleic anhydride can be replaced by maleimide, N-alkyl($C_{1-4}$) maleimides, N-phenylmaleimide, fumaric acid, itaconic acid, citraconic acid, aconitic acid, crotonic acid, cinnamic acid, alkyl($C_{1-18}$) esters of the foregoing acids, cycloalkyl($C_{3-8}$) esters of the foregoing acids, sulfated castor oil, or the like.

At least 95 wt % of the maleic anhydride co- or terpolymers have a number average molecular weight of in the range between about 700 and 100,000, preferrably between about 1000 and 50,000.

The hydrolyzed maleic anhydride polymers, of this invention are applied to polyamide textile substrates in the form of aqueous solutions or aqueous dispersions. They can be effectively applied to polyamide fibrous substrates by a wide variety of methods known to those skilled in the art, such as:

padding,
spraying,
foaming in conjunction with foaming agents,
batch exhaust in beck dyeing equipment, or
continuous exhaust during a continuous dyeing operation.

They can be applied by such methods to dyed or undyed polyamide textile substrates. In addition, they can be applied to such substrates in the absence or presence of a polyfluoroorganic oil-, water-, and/or soil-repellent materials. In the alternative, such a polyfluoroorganic material can be applied to the textile substrate before or after application of the polymers of this invention thereto.

The quantities of the polymers of this invention which are applied to the textile substrate are amounts effective in imparting stain-resistance to the substrate. Those amounts can be varied widely; in general, one can use between 1 and 5% by weight of them based on the weight of the textile substrate, usually 2.5% by weight or less. The aqueous solutions or dispersions of the polymers can be applied to polyamide substrate by methods known in the art. It is necessary that the aqueous solutions or dispersions of the polymers of this invention have a pH of 3 or less; otherwise stain-resistance will not be imparted to the polyamide substrates. However, more effective exhaust deposition can be obtained at a pH as low as 2.0. When the latter low pH is used, the preferred level of application to the textile substrate is about 2.5% by weight, based on the weight of the textile substrate. In an embodiment, a pH between about 2 and 3 is used. More effective stainblocking is obtained if the polymers are applied to the textile substrate at either 20° C. followed by heat treatment at a temperature in the range between about 50° and 150° C. for about 1 to 60 minutes, or applied at temperatures in the range between about 40° and 95° C. for about 1 to 60 minutes. For example, at a pH between about 2 and 3, a temperature between about 70° and 90° C. is preferred. However, stain-blocking can be obtained when application is effected even at that of cold tap water (10°–15° C.).

The polymers of this invention can also be applied in-place to polyamide carpeting which has already been installed in a dwelling place, office or other locale. They can be applied as a simple aqueous preparation or in the form of aqueous shampoo preparation, with or without one or more polyfluoroorganic oil-, water-, and/or soil-repellent materials. They may be applied as described above.

One can blend the stain-resists of the present invention with other known stain-resists, such as phenol-formaldehyde condensation products as disclosed in U.S. Pat. Nos. 4,833,009 and 4,965,325; methacrylic acid polymers disclosed in U.S. Pat. No. 4,937,123; or hydrolized polymers of maleic anhydride and one or more ethylenically unsaturated aromatic compounds described by Fitzgerald et al., or the olefin/maleic anhydride polymers disclosed in my copending application, both cited above.

The following Examples are illustrative of the invention. Unless otherwise indicated in the Examples and Evaluation Method given below, all parts and percentages are by weight and temperatures are in degrees Celsius.

EXAMPLE 1

A solution of 9.8 g of maleic anhydride (0.1 mol) and 10 g of n-butyl vinyl ether (0.1 mol) in 90 g of cumene was heated to 70° C. under agitation and nitrogen. A solution of 0.3 g of Vazo 67 initiator [2,2'-azobis-(2-methylbutyronitrile)] in 10 g of cumene was injected into the reaction vessel within half hour via a syringe pump. During this time period the exotherm reached 77° C. The reactants were agitated for another 2 hours at 70° C. before cooling to room temperature. A white solid product (12.5 g) was obtained by precipitation from a methanol/petroleum ether solution. Melting point range 155°–192° C. Number average molecular weight by vapor pressure osmometry (VPO): 9,370. Ten grams of the solid product was hydrolyzed at 80°–90° C. in the presence of 82.5 g of deionized water, 6.7 g of 30 wt % sodium hydroxide and 2 drops of a 1 wt % solution of benzyltriethylammonium chloride resulting after 1 to 2 hours in a clear yellowish solution containing 10% active ingredients.

EXAMPLE 2

A solution of 9.8 g of maleic anhydride (0.1 mol), 10 g of n-butyl vinyl ether (0.1 mol), 0.5 g of N,N-dimethylaniline and 0.3 g of Vazo 67 ® initiator [2,2'-azobis-(2-methylbutyronitrile)] in 20 g of methyl isobutyl ketone was added under stirring and nitrogen within one-half hour to 80 g of methyl isobutyl ketone held at 75° C. The reactants were agitated for another 3 hours at 75° C. before being poured into methanol at room temperature. A white solid formed (14.5 g) which was separated by filtration and air dried. The product had a melting point range between 155° and 206° C. and a number average molecular weight by gas phase chromatography (GPC) of 3,280. Hydrolysis was carried out as described in EXAMPLE 1.

EXAMPLE 3

The procedure was similar to that of EXAMPLE 1 using:

9.8 g maleic anhydride (0.1 mol)
10.0 g isobutyl vinyl ether (0.1 mol)

Hydrolysis was carried out as described in EXAMPLE 1.

EXAMPLE 4

The procedure was similar to that of EXAMPLE 1 using:

9.8 g maleic anhydride (0.1 mol)
15.6 g iso-octyl vinyl ether (0.1 mol)
Product: White powder (17.9 g)

Hydrolysis was carried out as described in EXAMPLE 1.

EXAMPLE 5

A solution of 9.8 g of maleic anhydride (0.1 mol), 7.5 g of n-butyl vinyl ether (0.075 mol) and 2.6 g of styrene (0.025 mol) in 90 g of cumene was heated to 70° C. under agitation and nitrogen. A solution of 0.3 g of Vazo 67 ® initiator [2,2'-azobis-(2-methylbutyronitrile)] in 10 g of cumene was added within one-half hour via a syringe pump. The reactants were held for another 4 hours at 70° C. at which time the reaction mass had become milky-white. The product was then cooled to room temperature and the solids separated by filtration giving 15.5 g of a white powder. The product had a melting point range between 177° and 255° C. and a number average molecular weight by gas phase chromatography (GPC) of 1500. Hydrolysis was carried out as described in EXAMPLE 1.

EXAMPLE 6

The procedure was similar to that of EXAMPLE 5 using:

9.8 g maleic anhydride (0.1 mol)
5.0 g n-butyl vinyl ether (0.05 mol)
5.2 g styrene (0.05 mol)

Product: White powder (18.8 g); melting range 195°–260° C.; number average molecular weight (VPO): 5,780; approximate terpolymer ratio by $^{13}C$ NMR:

n-Butyl Vinyl Ether/Styrene/Maleic Anhydride 0.35/0.53/1.00

Hydrolysis was carried out as described in EXAMPLE 1.

EXAMPLE 7

The procedure was similar to that of EXAMPLE 5 using:

9.8 g maleic anhydride (0.1 mol)
2.5 g n-butyl vinyl ether (0.025 mol)
7.8 g styrene (0. 075 mol)

Product: White powder (19.8 g); melting point range 205°–275° C.; number average molecular weight (GPC): 1,600

Hydrolysis was carried out as described in EXAMPLE 1.

EXAMPLE 8

A solution of 9.8 g of maleic anhydride (0.1 mol), 5.6 g of 1-octene (0.05 mol) and 5.0 g of n-butyl vinyl ether (0.05 mol) in 30 g of propylene glycol methyl ether acetate was heated under agitation and nitrogen to 95° C. A solution of 2 g of t-butyl peroxy-2-ethylhexanoate in 6 g of propylene glycol methyl ether acetate was then injected into the reaction vessel within half hour via a syringe pump. The reactants were agitated for another 2 hours at 95° C. before being cooled to room temperature. The product was then poured into methanol which caused precipitation of a white solid which was filtered and air-dried(15.5 g). Approximate terpolymer ratio by $^{13}C$ NMR:

1-octene/n-butyl vinyl ether/maleic anhydride 0.28/0.50/1.00.

Hydrolysis was carried out as described in EXAMPLE 1.

EXAMPLE 9

The procedure was similar to that of EXAMPLE 8 using:

9.8 g maleic anhydride (0.1 mol) 3.7 g
1-octene (0.033 mol) 3.3 g n-butyl vinyl
ether (0.033 mol) 3.5 g styrene (0.033 mol)

Product: White solid (18.1 g); Number average molecular weight (NMR): 3000 Approximate terpolymer ratio by $^{13}C$ NMR: 1-octene/n-butyl vinyl ether/-styrene/maleic anhydride=0.15/0.24/0.44/1.00

EXAMPLE 10

The procedure was similar to that of EXAMPLE 5 using:

9.8 g maleic anhydride (0.1 mol) 3.9 g
2-perfluorohexylethyl vinyl ether (0.01 mol)

9.4 g styrene (0.09 mol)

Product: White solid (20.3 g) Fluorine: 2.3 wt. %

EVALUATION METHOD

Nylon fiber was treated with 1.2 wt % of the stain-resists of EXAMPLEs 1–11 at a goods-to-liquor ratio of 1:32 at a pH of 2.35 for 45 minutes at 80° or 95° C. The fiber was then washed, air-dried and exposed at room temperature to a dye solution consisting of 0.2 g of FD&C Red Dye No. 40 and 3.2 g of citric acid in 1 liter of deionized water at a goods-to-liquor ratio of 1:40. After approximately 65 hours, the dye adsorbed onto the fiber was determined at a wavelength of 498–502 nm by comparing the absorbance with that of the Control. Thus a number of 90 means 90% of the dye is adsorbed, indicating little stain resistance to the dye. The lower the number, the better is the resistance to stain. The results of the evaluation are set forth in TABLE I.

TABLE I

| | PERCENT DYE ADSORBED | |
|---|---|---|
| EXAMPLE | At 80° C./pH 2.35 | At 95° C./pH 2.35 |
| 1 | 9 | 2 |
| 2 | 3 | — |
| 3 | 3 | 3 |
| 4 | 9 | 24 |
| 5 | 1 | 3 |
| 6 | 2 | 2 |
| 7 | 3 | 2 |
| 8 | 2 | 2 |
| 9 | 2 | 2 |
| 10 | 4 | 3* |

*Fluorine content of treated fiber was 300 ppm.

EXAMPLE 11

A solution of 9.8 g of maleic anhydride (0.1 mol), 12.7 g of 90% allyl n-butyl ether (0.1 mol) and 1.0 g of benzoyl peroxide in 60 g of cumene was heated under agitation and nitrogen to 70° C. After 4 hours another portion of benzoyl peroxide was added and the reaction mass was held for additional 17 hours at 70° C. under agitation and nitrogen. The volatiles were then removed from the resulting clear, pale yellow liquid by evaporation at reduced pressure (70°–85° C./10–20 mm Hg) giving 21.8 g of an amber solid. Hydrolysis was carried out as described in Example 1.

EXAMPLE 12

The procedure was similar to that of Example 11 using:

7.7 g maleic anhydride (0.078 mol)

10.5 g allyl phenyl ether (0.078 mol)

1.2 g benzoyl peroxide 50.0 g cumene

Product: 18.1 g of an amber solid. Hydrolysis was carried out as described in Example 1.

The polymers of EXAMPLEs 11 and 12were evaluated by the EVALUATION METHOD at 1.2 wt. % and 2.4 wt. % to give the results set for in TABLE II.

TABLE II

| | PERCENT DYE ADSORBED | | | |
|---|---|---|---|---|
| | AT 80° C./pH 2.35 | | AT 95° C./pH 2.35 | |
| EXAMPLE | 1.2% | 2.4% | 1.2% | 2.4% |
| 11 | 27 | 2 | 75 | 7 |

TABLE II-continued

| | PERCENT DYE ADSORBED | | | |
|---|---|---|---|---|
| | AT 80° C./pH 2.35 | | AT 95° C./pH 2.35 | |
| EXAMPLE | 1.2% | 2.4% | 1.2% | 2.4% |
| 12 | 21 | 0 | 71 | 9 |

I claim:

1. A process for imparting resistance to staining of a polyamide textile substrate by an acid dye which comprises applying to said substrate an effective amount of an aqueous solution or an aqueous dispersion of a composition comprising a water-soluble or water-dispersible hydrolyzed polymer of maleic anhydride and (a) an allyl ether or (b) a vinyl ether or a mixture of the same having a pH of 3 or less, wherein said polymer contains between about 0.7 and 1.3 polymer units derived from one or more allyl or vinyl ether monomers per polymer unit derived from maleic anhydride, and said ether is represented by the formula:

$$CH_2{=}CH{-}(CH_2)_k{-}O{-}(CH_2)_m{-}(A)_n{-}R$$

wherein

R is hydrogen or an alkyl radical containing 4 to 8 carbon atoms;

A is a divalent radical $-SO_2R^1-$ or $-CONR^1-$ in which $R^1$ is hydrogen or an alkyl radical containing 1 to 6 carbon atoms;

k is 0 or 1;

m is 0 or 2; and n is 0 or 1.

2. The process of claim 1 wherein said polymer contains about one polymer unit derived from maleic anhydride per polymer unit derived from one or more allyl ether monomers or vinyl ether monomers.

3. The process of claim 1 wherein said ether is n-butyl vinyl ether.

4. The process of claim 1 wherein at least 95 wt % of said polymers have a number average molecular weight of about 700 to 100,000.

5. The process of claim 1 wherein at least 95 wt % of said polymers have a number average molecular weight of about 1000 to 50,000.

6. The process of claim 1 wherein up to 90 weight % of said ether is replaced by one or more alpha-olefins or ethylenically unsaturated aromatic compounds.

7. The process of claim 6 wherein said alpha-olefin is a 1-alkene containing 4 to 18 carbon atoms.

8. The process of claim 7 wherein said 1-alkene is isobutylene.

9. The process of claim 8 wherein said alpha-olefin is a diene containing 4 to 18 carbon atoms.

10. The process of claim 9 wherein said diene is butadiene.

11. The process of claim 6 wherein said ethylenically unsaturated aromatic compound is styrene.

12. The process of claim 1 wherein up to 50 weight % of said ether is replaced by one or more of a $C_1$ to $C_4$ alkyl acrylate or methacrylate, vinyl acetate, vinyl chloride, vinylidine chloride, vinyl sulfide, N-vinyl pyrrolidone, acrylonitrile, or acrylamide, or mixtures of the same.

13. The process of claim 1 wherein up to 75 weight % of said maleic anhydride is replaced by maleimide, N-alkyl($C_{1-4}$) maleimides, N-phenylmaleimide, fumaric acid, itaconic acid, citraconic acid, aconitic acid, crotonic acid, cinnamic acid, alkyl($C_{1-18}$) or cycloalkyl($C_{3-8}$) esters of the foregoing acids or sulfated castor oil.

14. The process of claim 1 wherein up to 30 weight % of the maleic anhydride is replaced by acrylic or methacrylic acid.

* * * * *